United States Patent [19]

Charron

[11] Patent Number: 4,638,509

[45] Date of Patent: Jan. 27, 1987

[54] PROTECTIVE OUTER GARMENT FOR DIVERS

[76] Inventor: Rene Charron, 4115 - 67 Street N. W., Calgary, Canada, T3B 2J2

[21] Appl. No.: 778,642

[22] Filed: Sep. 23, 1985

[51] Int. Cl.[4] ..... B63C 11/04; A41D 13/00

[52] U.S. Cl. ..... 2/2.1 R; 2/22; 2/46; 2/79; 2/227

[58] Field of Search ..... 2/46, 79, 22, 23, 227, 2/2.1 R

[56] References Cited

U.S. PATENT DOCUMENTS

| | | | |
|---|---|---|---|
| 1,071,483 | 8/1913 | Vance | 2/79 |
| 2,967,308 | 1/1961 | Freese | 2/227 X |
| 3,269,036 | 8/1966 | Parker et al. | 2/22 X |
| 3,533,106 | 10/1970 | Kremp | 2/22 |
| 3,800,330 | 4/1974 | Bowcut | 2/227 |

*Primary Examiner*—Louis K. Rimrodt

*Attorney, Agent, or Firm*—George H. Dunsmuir

[57] ABSTRACT

Protective trousers for wearing over the lower portion of a dry or wet diving suit include a pair of panels joined at the crotch area and defining leg, hip and waist encircling elements. Clips and straps are provided for connecting the open side edges of the trousers, and for securing the bottom ends of the trousers to the feet of a user.

2 Claims, 2 Drawing Figures

PROTECTIVE OUTER GARMENT FOR DIVERS

BACKGROUND OF THE INVENTION

This invention relates to a garment, and in particular to protective trousers for use by divers.

When using a dry suit for diving the entire suit is filled with air, because the suit is used as a buoyancy compensator. The dry suited diver must remain in the horizontal or head up position. In the inverted position, the diver tends to float to the surface upside down which is unsafe. It is often difficult to create sufficient momentum to right the body. The fast flow of air to the feet tends to blow off the diver's flippers or fins, and without fins it is virtually impossible to retain mobility. Moreover the uncontrolled inverted position often causes rapid ascent, which is potentially dangerous for sport and commercial divers.

Obviously, there exists a need for some form of protection against the problem outlined above. The object of the present invention is to meet such need.

BRIEF SUMMARY OF THE INVENTION

Accordingly, the present invention relates to protective trousers for use by divers comprising panel means defining leg, hip and waist encircling trousers, thread means permanently interconnecting said panel means along at least one edge thereof, whereby the panel means define trousers open along the entire length of at least one side thereof, loop means for engaging the feet of a user for retaining the trousers over substantially the entire length of the legs of a user; and coupling means for closing the open side of the trousers.

With the structure of the present invention, air is not permitted to expand below the waist of the diver. Thus, shifting of the centre of gravity, causing the feet to get above the head is prevented. A dry suited diver can descend head first or swim in the horizontal position without loss of control. Moreover, the possibility of the loss of flippers or fins in the inverted position is substantially reduced.

Figure 2:
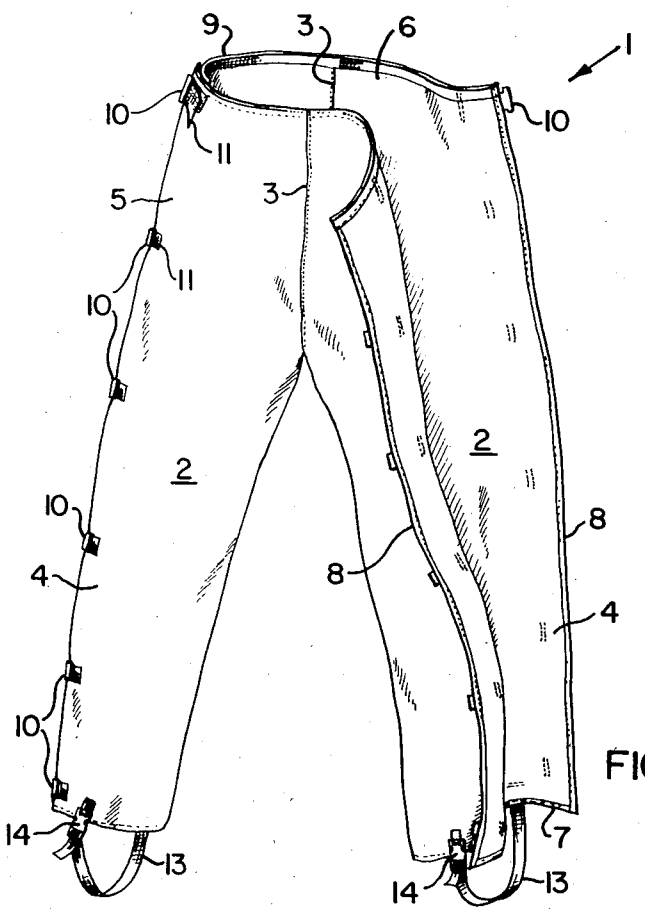
FIG. 2 is a perspective view of the protective trousers open along the entire length of each side.
Figure 1:
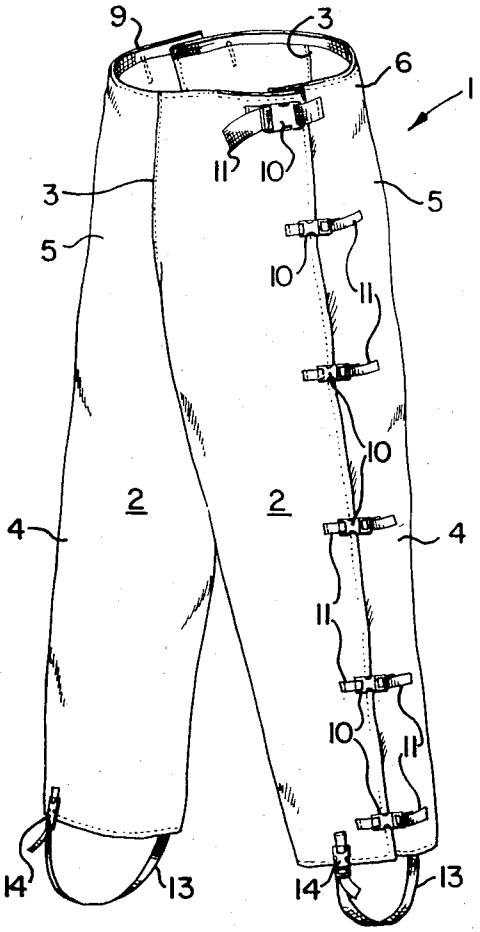
FIG. 1 is a perspective view of the protective trousers of the present invention.

Referring to the drawing, the protective trousers of the present invention generally indicated at 1 include a pair of panels 2. The panels 2 are sewn together at 3 in the crotch area to define legs 4, a hip portion 5 and a waist portion 6. The trousers are open at each side for easy placing over a diving suit. The bottoms of the legs 4, the free side edges of the panels 2 and the open top end or waist are reinforced by strips of material 7, 8 and 9, respectively.

The trousers 1 are placed over the bottom of a diving suit (not shown), and the free edges of the panels 2 are connected to each other by conventional plastic clips 10 on straps 11. The trouser legs 4 are maintained stretched over the legs of a user by straps 13 and clips 14. The straps 11 are sufficiently tight that air flow to the legs and feet is restricted which prevents expansion of the lower half of the diving suit. Buoyancy remains in the upper body portion of the suit to maintain stability. Obviously, in the inverted diving position, the fins are not subjected to quick air flow, and the diver can maintain a safe, controlled attitude. The trousers also offer protection against underwater rocks, barnacles, etc.

While specifically designed for use with a dry suit, the trousers can also be used with a wet suit. The structure shown in the drawing is preferred, but a single split on one side can be used. Obviously, pockets for knives, etc. can be provided in the trousers.

What I claim is:

1. Protective trousers for use by divers in combination with a diving suit for preventing the expansion of air below the waist of the user comprising panel means defining leg, hip and waist encircling trousers, thread means permanently interconnecting said panel means along at least one edge thereof, whereby said panel means define trousers having openings along the entire length of at least one side thereof to permit the escape of air without disrupting the buoyancy of the user, loop means for engaging the feet of a user for retaining the trousers over substantially the entire length of the legs of a user; and coupling means for closing said open side of said trousers.

2. Protective trousers according to claim 1, wherein said panel means define trousers open along the entire length of each side thereof.

* * * * *